US011454898B2

(12) United States Patent
Yoshida et al.

(10) Patent No.: US 11,454,898 B2
(45) Date of Patent: Sep. 27, 2022

(54) GAP ADJUSTMENT OF NON-CONTACT CHARGING ROLLER

(71) Applicant: Hewlett-Packard Development Company, L.P., Spring, TX (US)

(72) Inventors: Yoichi Yoshida, Yokohama (JP); Yasuyuki Ishii, Yokohama (JP); Koichiro Takashima, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/414,094

(22) PCT Filed: Jun. 22, 2020

(86) PCT No.: PCT/US2020/038938
§ 371 (c)(1),
(2) Date: Jun. 15, 2021

(87) PCT Pub. No.: WO2020/263738
PCT Pub. Date: Dec. 30, 2020

(65) Prior Publication Data

US 2022/0107577 A1 Apr. 7, 2022

(30) Foreign Application Priority Data

Jun. 24, 2019 (JP) ..... JP2019-116190

(51) Int. Cl.
*G03G 15/02* (2006.01)
*G03G 21/16* (2006.01)
(Continued)

(52) U.S. Cl.
CPC ..... *G03G 15/025* (2013.01); *G03G 15/0258* (2013.01); *G03G 15/0266* (2013.01);
(Continued)

(58) Field of Classification Search
CPC ..... G03G 15/025; G03G 15/0258; G03G 15/0266; G03G 15/0275; G03G 21/1671;
(Continued)

(56) References Cited

U.S. PATENT DOCUMENTS 7,454,154 B2 11/2008 Matsumoto et al.
2007/0025766 A1 2/2007 Kamoshida et al.
(Continued)

FOREIGN PATENT DOCUMENTS

JP 1997305007 A 6/1996
JP 2002108099 A 4/2002
(Continued)

*Primary Examiner* — Joseph S Wong
(74) *Attorney, Agent, or Firm* — Staas & Halsey LLP

(57) ABSTRACT

An image forming apparatus includes: an image carrier having a first rotation axle, a charging roller having a second rotation axle, a conductive member to contact a surface of the image carrier, a gap size acquisition device, and a gap adjustment device. The charging roller is disposed adjacent to the image carrier in a non-contact manner across a gap to charge the image carrier. The gap size acquisition device acquires a size of the gap. The gap adjustment device adjusts a distance between the first rotation axle and the second rotation axle based on information from the gap size acquisition device to maintain the size of the gap within a predetermined range.

20 Claims, 11 Drawing Sheets

(51) Int. Cl.
*G03G 15/00* (2006.01)
*G03G 21/00* (2006.01)

(52) U.S. Cl.
CPC ..... *G03G 15/0275* (2013.01); *G03G 21/1671* (2013.01); *G03G 15/50* (2013.01); *G03G 21/0011* (2013.01); *G03G 2215/025* (2013.01)

(58) Field of Classification Search
CPC . G03G 2215/025; G03G 15/50; G03G 21/011
See application file for complete search history.

(56) References Cited

U.S. PATENT DOCUMENTS

| | | | | |
|---|---|---|---|---|
| 2009/0060602 | A1* | 3/2009 | Yamaguchi ..... | G03G 15/5033 399/350 |
| 2011/0274448 | A1* | 11/2011 | Yamashita ..... | G03G 15/025 399/31 |
| 2013/0121725 | A1* | 5/2013 | Shirayanagi ..... | G03G 21/1814 399/111 |
| 2013/0343771 | A1* | 12/2013 | Pines ..... | G03G 15/0266 399/176 |
| 2018/0017886 | A1* | 1/2018 | Borenstain ..... | G03G 15/025 |

FOREIGN PATENT DOCUMENTS

| | | | |
|---|---|---|---|
| JP | 2004085766 | A | 3/2004 |
| JP | 2005234185 | A | 9/2005 |
| JP | 2008242141 | A | 10/2008 |
| KR | 20070054062 | A | 11/2005 |
| KR | 0476761 | | 11/2014 |

* cited by examiner

GAP ADJUSTMENT OF NON-CONTACT CHARGING ROLLER

BACKGROUND

An image forming apparatus of electrophotography is operated to adhere toner to an image carrier having a latent image formed thereon, to transfer the toner to paper, and to fix the transferred toner onto the paper.

The image carrier is also referred to as a photosensitive drum, and allows toner to be adhered thereto by charging. The image forming apparatus has a charging device for charging a surface of the image carrier. In addition, the image forming apparatus also has a cleaning blade to clean the photosensitive drum by scraping a developer which is present on the photosensitive drum after the transferring of a toner image. Some charging devices include a charging roller facing an image carrier, and forming a minute gap therebetween, to charge the image carrier by electric discharge in a non-contact state.

DETAILED DESCRIPTION

Figure 1:
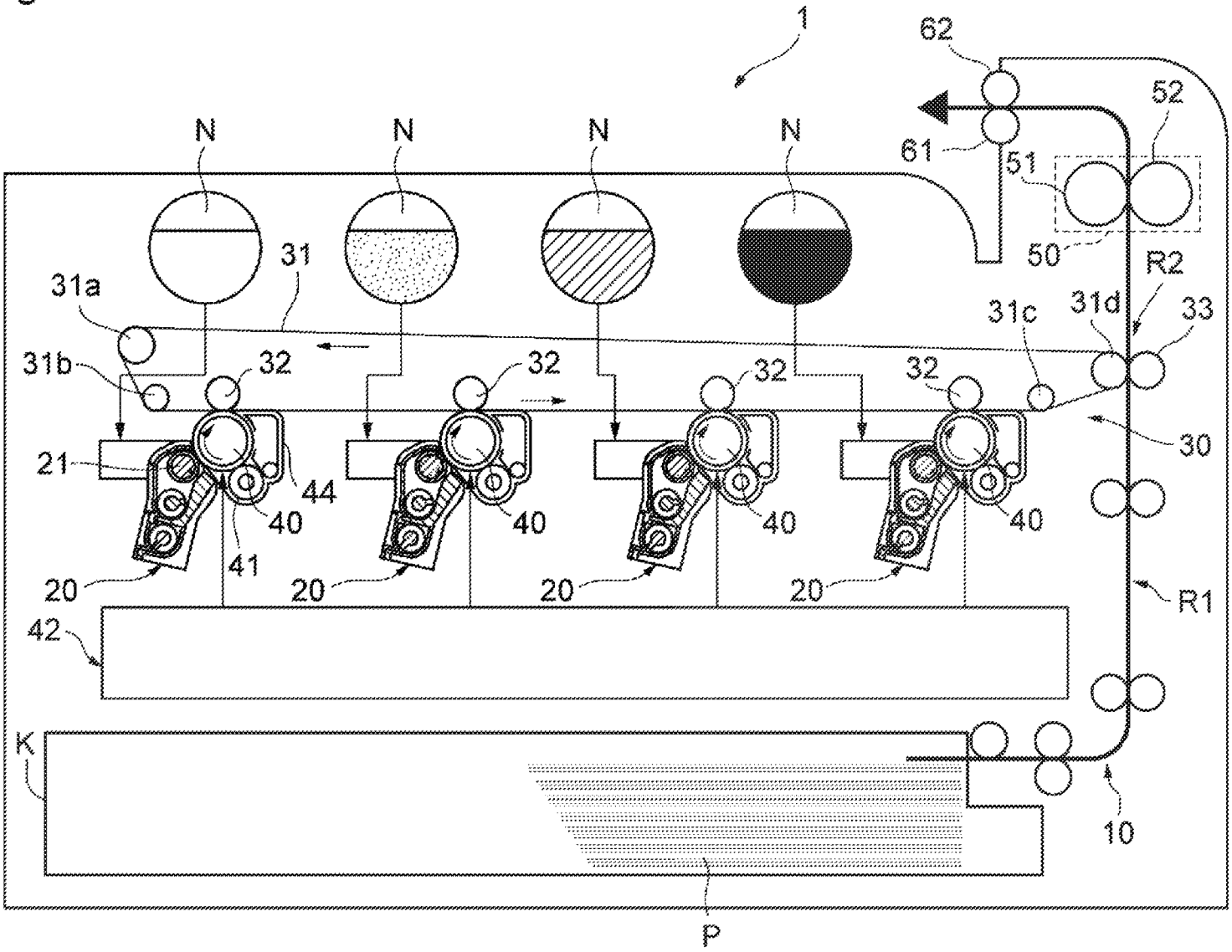
FIG. 1 is a schematic diagram of an example image forming apparatus.

In the following description, with reference to the drawings, the same reference numbers are assigned to the same components or to similar components having the same function, and overlapping description is omitted.

An example image forming apparatus may include: an image carrier, a charging roller, a conductive member, a gap size acquisition unit (or gap size acquisition device), and a gap adjustment mechanism (or gap adjustment device). The image carrier has a first rotation axle that extends along a first rotation axle. The charging roller has a second rotation axle that extends along a second rotation axle extending parallel with the first rotation axle. The charging roller being disposed adjacent to the image carrier in a non-contact manner across a gap to charge the image carrier (e.g., the gap is formed between the charging roller and the image carrier). The conductive member may contact a surface of the image carrier. The gap size acquisition unit (device) may acquire a size of the gap. The gap adjustment mechanism (or device) may adjust a distance between the first rotation axle and the second rotation axle based on information from the gap size acquisition unit (device) to maintain the size of the gap within a predetermined range. The example image forming apparatus may adjust a size of the gap that increases as the number of times of image formation increases (e.g., a number of rotations during operation) to maintain the size of the gap within a predetermined range, and eventually may enhance the quality of images by stabilizing the discharge characteristic in a charging process.

An example gap size acquisition unit (or device) is operable to: apply a first voltage to the conductive member to detect a first current through the image carrier, thereby acquiring a first voltage-current characteristic representing a surface film thickness of the image carrier; apply a second voltage to the charging roller to detect a second current through the image carrier, thereby acquiring a second voltage-current characteristic representing a sum of the surface film thickness of the image carrier and the size of the gap (e.g., between the charging roller and the image carrier); and acquire the size of the gap based on the first voltage-current characteristic and the second voltage-current characteristic. In some examples, the first voltage and the second voltage may each be lower than a discharge starting voltage. Such an image forming apparatus may acquire a size of the gap more precisely, and may maintain the size of the gap within a predetermined range more precisely.

In some examples, the conductive member may include a lubricant coater device having a rotatable conductive elastic body to apply a lubricant agent to the surface of the image carrier, or may include a conductive cleaning blade to clean the surface of the image carrier. Such an image forming apparatus may forgo any additional conductive member to acquire the first voltage-current characteristic without any additional conductive member, which may reduce the cost.

In some examples, the gap adjustment mechanism (or device) may include an eccentric cam abutting with the second rotation axle. In some examples, the eccentric cam has a third rotation axle extending along a third rotational axis, and the third rotation axle may be mounted at a position that is radially offset from a center of the eccentric cam. In some examples, the image forming apparatus may include a drive device for rotating the third rotation axle of the eccentric cam so as to adjust the size of the gap. Accordingly, the example image forming apparatus may maintain a size of the gap within a predetermined range by mechanically adjusting the size of the gap that increases as the number of times of image formation increases, in order to maintain and/or enhance the image quality over time by stabilizing the discharge characteristic in the charging process.

In some examples, the image forming apparatus may include an alarm (or alarm unit, or alarm device), wherein an alarm (or alarm indication) is generated by the alarm unit (or device) when the size of the gap exceeds a predetermined adjustment range. Accordingly, the example image forming apparatus may appropriately notify a user or the like of a malfunction or the like occurring in the image forming apparatus.

In another example image forming apparatus provided with a charging roller disposed adjacent to a rotatable image carrier in a non-contact manner across a gap, there is provided an example method for adjusting a size of the gap. The method includes: applying a first voltage to a conductive member that is in contact with a surface of the image carrier to detect a first current through the image carrier, thereby acquiring a first voltage-current characteristic representing a surface film thickness of the image carrier; applying a second voltage to the charging roller to detect a second current through the image carrier, thereby acquiring a second voltage-current characteristic representing a sum of the surface film thickness of the image carrier and a size of the gap; acquiring the size of the gap based on the first voltage-current characteristic and the second voltage-current characteristic; and adjusting the distance between a rotation axle of the charging roller and a rotation axle of the image carrier based on the size of the gap acquired.

In some examples, the method adjusts a size of the gap that increases as the number of times of image formation increases, thereby maintaining the size of the gap within a predetermined range, in order to maintain and/or enhance the image quality over time, by stabilizing the discharge characteristic in the charging process.

In some example methods, adjusting the distance is performed by rotating an eccentric cam that is in abutment with the rotation axle of the charging roller, to maintain a size of the gap within a predetermined range by mechanically adjusting the size of the gap.

In some example methods, the first voltage and the second voltage may each be lower than a discharge starting voltage, in order to determine a size of the gap more precisely, and to maintain the size of the gap within a predetermined range more precisely.

In some example methods, the conductive member may be a lubricant coater device having a rotatable conductive elastic body to apply a lubricant agent on the surface of the image carrier, or may be a conductive cleaning blade to clean the surface of the image carrier. Such a method does not require an additional conductive member for acquiring the first voltage-current characteristic, which may reduce cost.

In some examples, the method includes generating an alarm (or alarm indication) when the size of the gap acquired exceeds a predetermined adjustment range, in order to notify a user or the like of a malfunction or the like, occurring in the example image forming apparatus.

With reference to FIG. 1, an example image forming apparatus 1 may be an apparatus for forming a color image using magenta, yellow, cyan and black colors. The example image forming apparatus 1 may have a recording medium conveyance unit (or recording medium conveyance device) 10 for conveying paper P, developing devices 20 for developing an electrostatic latent image, a transfer unit (or transfer device) 30 for secondarily transferring a toner image onto the paper P, photosensitive drums 40 as an electrostatic latent image carriers for forming an image on an outer circumferential surface thereof, and a fixing unit (or fixing device) 50 for fixing the toner image on the paper P.

The recording medium conveyance unit 10 may convey the paper P, on which an image is to be formed, along a conveyance path R1 The paper P may be stacked and accommodated in a cassette K. The recording medium conveyance unit 10 conveys the paper P via the conveyance path R1, to a secondary transfer region R2 at a timing when a toner image to be transferred onto the paper P arrives at the secondary transfer region R2.

An example developing device 20 may be provided for each color, and in total, four developing devices may be provided. Each developing device 20 may have a developing roller 21 for allowing toner to be carried on the photosensitive drum 40. The developing device 20 adjusts a mixing ratio of toner and carrier to a targeted ratio, and mixes and stirs the toner and carrier to disperse toner uniformly, so that a developer (containing the toner and carrier) having an optimal charge amount imparted thereto may be adjusted. This developer is carried on the developing roller 21. When the rotation of the developing roller 21 conveys the developer to a region facing the photosensitive drum 40, toner from the developer carried on the developing roller 21 is moved (or transferred) onto the electrostatic latent image formed on the outer circumferential surface of the photosensitive drum 40, and the electrostatic latent image may be developed.

The example transfer unit 30 may convey a toner image formed by the developing device 20 to the secondary transfer region R2 where the toner image is to be secondarily transferred to the paper P. The transfer unit 30 may include a transfer belt 31, support rollers 31*a*, 31*b*, 31*c* and 31*d* for supporting the transfer belt 31, a primary transfer roller 32 holding the transfer belt 31 together with the photosensitive drum 40, and a secondary transfer roller 33 holding the transfer belt 31 together with the support roller 31*d*.

The transfer belt 31 may be an endless belt, which is circularly moved by support rollers a, 31*b*, 31*c* and 31*d*. The primary transfer roller 32 may be provided so as to press the photosensitive drum 40 from an inner circumference of the transfer belt 31. The secondary transfer roller 33 may be provided so as to press the support roller 31*d* from an outer circumference of the transfer belt 31.

One photosensitive drum 40 is provided for each color, so as to provide four photosensitive drums 40 in total. Each photosensitive drum 40 may be provided along a moving direction of the transfer belt 31. The developing device 20, a charging roller 41, an exposure unit (or exposure device) 42 and a cleaning unit (or cleaning device) 43 may be positioned about the photosensitive drum 40.

The charging roller 41 may uniformly charge the surface of the photosensitive drum 40 at a predetermined electric potential. The charging roller 41 may rotate as it follows the rotation of the photosensitive drum 40. The exposure unit 42 may irradiate light to the surface of the photosensitive 40, which has been charged by the charging roller 41, in accordance with the image to be formed on the paper P. This changes the electric potential of a portion, which has been exposed to the exposure unit 42, of the surface of the photosensitive drum 40, and thereby, an electrostatic latent image may be formed. Each of the four developing devices 20 develops an electrostatic latent image formed on the photosensitive drum 40 by toner supplied from an associated one of the toner tanks N provided to face the respective developing devices 20, so that a toner image is generated. The toner tanks N are respectively filled with magenta, yellow, cyan and black toners. The cleaning unit 43 collects toner remaining on the photosensitive drum 40 after the toner image formed on the photosensitive drum 40 is primarily transferred to the transfer belt 31. In some examples, the photosensitive drum 40 and the charging roller 41 are attached to a housing, which forms a cleaning unit (or cleaning device) 44. For example, the cleaning unit 44, the photosensitive drum 40 and the charging roller 41 may form a single unit device.

The fixing unit 50 may adhere and fix the toner image, which is secondarily transferred from the transfer belt 31 to the paper P. The fixing unit 50 may have a heating roller 51 for heating the paper P and a pressing roller 52 for pressing the heating roller 51. The heating roller 51 and the pressing roller 52 are formed in a cylindrical shape, and the heating roller 51 may have a heat source such as a halogen lamp. A fixing nip portion is a contact region formed between the heating roller 51 and the pressing roller 52, and the toner image is melted on and fixed to the paper P, by passing the paper P through the fixing nip portion.

The example image forming apparatus 1 may be provided with discharge rollers 61, 62 for discharging the paper P having the toner image fixed by the fixing unit 50, to the outside of the apparatus.

Example printing operations of the example image forming apparatus 1 will be described. When an image signal of an image to be recorded is input into the image forming apparatus 1, a control section of the image forming apparatus 1 allows the charging roller 41 to uniformly charge the surface of the photosensitive drum 40 at a predetermined electric potential (charging process) based on the input image signal. The exposure unit 42 applies laser light to the surface of the photosensitive drum 40 to form an electrostatic latent image (exposure process).

In the developing device 20, the electrostatic latent image is developed, so that a toner image is formed (developing process). The thus-formed toner image is primarily transferred from the photosensitive drum 40 to the transfer belt 31 in a region where the photosensitive drum 40 and the transfer belt 31 face each other (transfer process). Toner images formed on the four photosensitive drums 40 are sequentially layered or superimposed on the transfer belt 31, so that a single composite toner image may be formed. Then, the composite toner image may be secondarily transferred to the paper P that is conveyed from the recording medium conveyance unit 10 in the secondary transfer region R2 where the support roller 31*d* and the secondary transfer roller 33 face each other.

The paper P having the composite toner image secondarily transferred thereon may be conveyed to the fixing unit 50. The paper P is conveyed between the heating roller 51 and the pressing roller 52 while heat and pressure are applied to the paper; and thereby, the composite toner image is melted and fixed onto the paper P (fixing process). Thereafter, the paper P is discharged by the discharge roller 61, 62 to the outside of the image forming apparatus 1.

Figure 2:
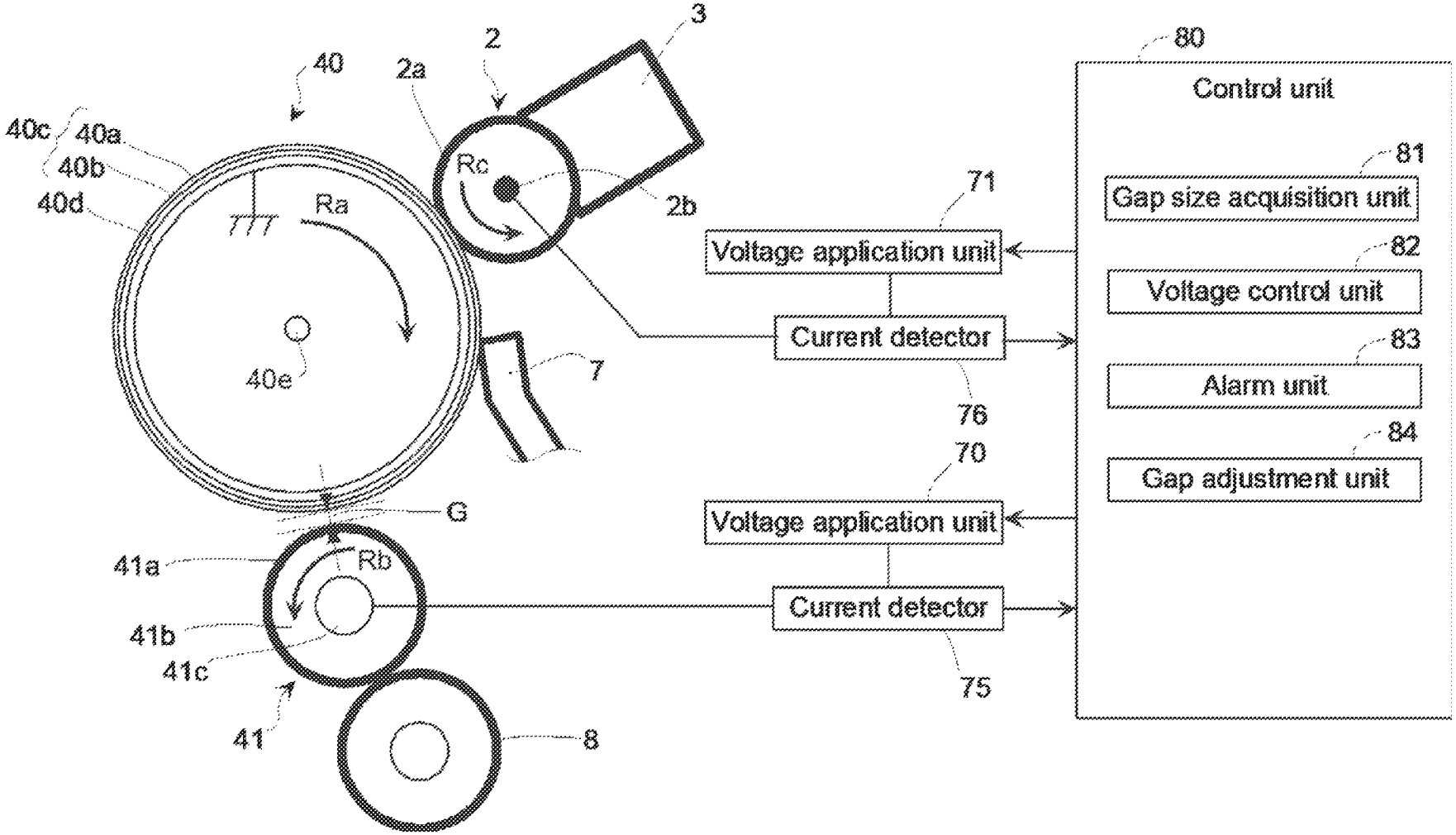
FIG. 2 is a schematic diagram illustrating example components of an image forming apparatus, including a photosensitive drum 40.

With reference to FIG. 2, an example configuration in the vicinity of the photosensitive drum 40 and the charging roller 41 in the example image forming apparatus 1 will be described. FIG. 2 is a configuration view schematically showing the vicinity of the photosensitive 40 according to one example. Part of the developing device 20 and other components may be omitted in FIG. 2, for ease of understanding.

The photosensitive drum 40 is a drum-shaped electrostatic latent image carrier, on an outer circumferential surface of which an image is formed. The photosensitive drum 40 includes an organic photoconductor (OPC), and may have a configuration wherein a photosensitive layer 40*c* is provided on a conductive support 40*d*. The conductive support 40*d* may be a hollow body (pipe shape) or a solid body (rod shape) made of a metal such as aluminum, copper and stainless (e.g., stainless steel).

The photosensitive layer 40*c* may be a photosensitive layer of negatively charged lamination type or a photosensitive layer of positively charged single layer type, depending on examples. With reference to FIG. 2, the photosensitive layer 40*c* may include a photosensitive layer of negatively charged lamination type, and the photosensitive layer 40*c* is configured by laminating a charge transport layer 40*a* on a charge generation layer 40*b*. The charge generation layer 40*b* may include a charge generation material, and a resin or the like. The charge transport layer 40*a* may include of a hole transport material as one kind of charge transport material, and a resin or the like. The film thickness of the charge transport layer 40*a* may be about 30 μm. The photosensitive drum 40 may be rotated in a direction of the arrow Ra at a constant speed, by a drive motor around a rotation axle 40*e*.

The charging roller 41 is a charging device that uniformly charges the surface of the photosensitive drum 40 at a predetermined electric potential. In the example image forming apparatus 1, the charging roller 41 is disposed adjacent to the photosensitive drum 40 in a non-contact manner across a minute gap G. For example, the charging roller 41 is spaced apart from the photosensitive drum 40 to form a gap G between the photosensitive drum 40 and the charging roller 41. The size of the gap G (also referred to herein as a gap size) may be of 10 μm to 100 μm, 10 μm to 50 μm, 10 μm to 30 μm, 10 μm to 20 μm, or 10 μm in other examples. The charging roller 41 may be rotated in a direction of the arrow $R_b$ via a rotation axle 41*c* (e.g., which may extend along a rotational axis) by a drive motor as it follows the rotation of the photosensitive drum 40.

The charging roller 41 may include a conductive support (conductive rotation axle) 41*c*, a conductive intermediate layer 41*b* laminated on the conductive support 41*c*, and a surface layer 41*a* laminated on the conductive intermediate layer 41*b*. The conductive support 41*c* may be made of a conductive metal, and may be a hollow body (pipe shape) in some examples, or a solid body (rod shape) in other examples, which may be made of a metal such as iron, copper, aluminum or stainless (e.g., stainless steel). The conductive intermediate layer 41*b* and the surface layer 41*a* may each contain a resin or the like. For example, the conductive intermediate layer 41*b* may be made of a urethane resin, and the surface layer 41*a* may be made of an acrylic resin. The surface layer 41*a* may have a thickness of, for example, about 15 μm. When an image is formed, a predetermined charge voltage (e.g., charge bias) may be applied to the conductive support 41*c* of the charging roller 41 by a voltage application unit (or voltage application device) 70. The voltage application unit (device) 70 may be controlled by a voltage control unit (or voltage control device) 82, and the voltage application unit 70 may output a predetermined charge voltage when an image is formed, or output a detection voltage different from the charge voltage when a size of gap G is acquired. The acquisition of the size of gap G will be described further below. A cleaning roller 8 is provided along the circumference of the charging roller 41. The cleaning roller 8 may serve to clean the surface of the charging roller 41.

In some examples, the voltage application unit (device) 70 has a DC power and an AC power. The outer circumferential surface (surface) of the rotating photosensitive drum 40 may be charged to a predetermined electric potential with a predetermined polarity (e.g., negative polarity) by the charging roller 41 applied with a charging bias. In some examples, a voltage having an AC voltage superimposed on a DC voltage may be applied to the charging roller 41, to cause an electric discharge at a location where the gap G is formed in the photosensitive drum 40, and thereby charge the photosensitive drum 40.

An application roller 2 may be provided along the circumference of the photosensitive drum 40. The application roller 2 is positioned upstream from the cleaning blade 7 in a rotation direction of the photosensitive drum 40. The application roller 2 may rotate in a direction of arrow $R_c$ as it follows the rotation of the photosensitive drum 40. The application roller 2 may carry a lubricant agent supplied from a lubricant supply body 3, and may apply the carried lubricant agent to the surface of the photosensitive drum 40. The lubricant supply body 3 may be pressed against the application roller 2 by an elastic member. The lubricant agent may reduce friction with the surface of the photosensitive drum 40.

The application roller 2 has a conductive rotation axle (that extends along a rotational axis) 2*b* and an elastic body 2*a* formed on a circumferential surface of the conductive rotation axle 2*b*, and both end portions of the conductive rotation axle 2*b* may be rotatably supported by a bearing member, for example. The conductive rotation axle 2*b* may be made of a metal such as iron, copper, aluminum and stainless (e.g., stainless steel). The elastic body 2*a* may be formed of a raised fiber nap (or nap-raised fiber). For example, the elastic body 2*a* may include a brush-shaped elastic body. When the elastic body 2*a* also serves as a conductive member in contact with the surface of the photosensitive drum 40 when the size of gap G is acquired, the elastic body 2*a* may be conductive as described below. For example, the conductive elastic body may be made of a conductive PET (polyethylene terephthalate) resin. In some examples, the application roller 2, the lubricant supply body 3 and others may be attached to a housing, which forms a cleaning unit (cleaning device) 44. The cleaning blade 7, which may be part of the cleaning unit 44, may collect toner (e.g., residual toner remaining after transfer) remaining on the photosensitive drum 40 even after primarily transferring a toner image from the photosensitive drum 40 to an intermediate transfer body (e.g., transfer belt 31). The cleaning blade 7 is pressed to the surface of the photosensitive drum 40, so it may scrape and remove toner remaining after transfer, on the surface of the photosensitive drum 40. In some examples, the cleaning blade 7 may be conductive, to also serve as a conductive member in contact with the surface of the photosensitive drum 40 at the time of acquisition of the size of gap G, as will be described below.

In some image forming apparatuses, the outer circumferential surface (surface) of the photosensitive drum 40 is scraped by the cleaning blade 7, the developer and the like, as the image forming apparatus is operated over time, and an electric discharge at the charging process may accelerate the formation and/or deepening of abrasion on the outer circumferential surface. Accordingly, the film thickness of the charge transport layer 40*a* of the photosensitive drum 40 may decrease. Thus, the size of gap G may tend to increase as the image forming apparatus is operated over time (e.g., as the number of the times of image formation increases). When the size of gap G increases, electric discharge at a location where the gap G is formed becomes unstable, thereby affecting the quality of the images formed. Hence, according to an example, the size of gap G that tends to increase may be mechanically adjusted to maintain the size of gap G at an optimal or target value, or within a predetermined range, thereby stabilizing the discharge characteristic in the charging process and maintaining or improving of image quality over time.

Adjustment of Gap G

An adjustment of the size of gap G may be performed at the time when the image forming apparatus 1 does not form an image (e.g., when the image forming apparatus 1 does not perform a printing operation). For example, the adjustment of the gap size may be performed during a pre-rotation period which is a warming-up period of the image forming apparatus 1 or a post-rotation period which is a period after the end of an image formation operation.

The adjustment of the size of gap G will be described with reference to FIG. 2. A conductive member that is in contact with the surface of the photosensitive drum 40 is used to apply a detection voltage of AC voltage (inter-peak voltage $V_{pp}$) to the photosensitive drum 40 and to measure a current through the photosensitive drum 40. For example, with reference to FIG. 2, the application roller 2 may serve as the conductive member. In another example, the conductive member may be a conductive cleaning blade 7 in which case, a current detector 76 may be connected to the conductive cleaning blade 7. In still another example, a conductive member that is exclusively used to apply a detection voltage and is in contact with the surface of the photosensitive drum 40 may be provided. In this case, the current detector 76 may be connected to the conductive member for exclusive use.

Figure 3:
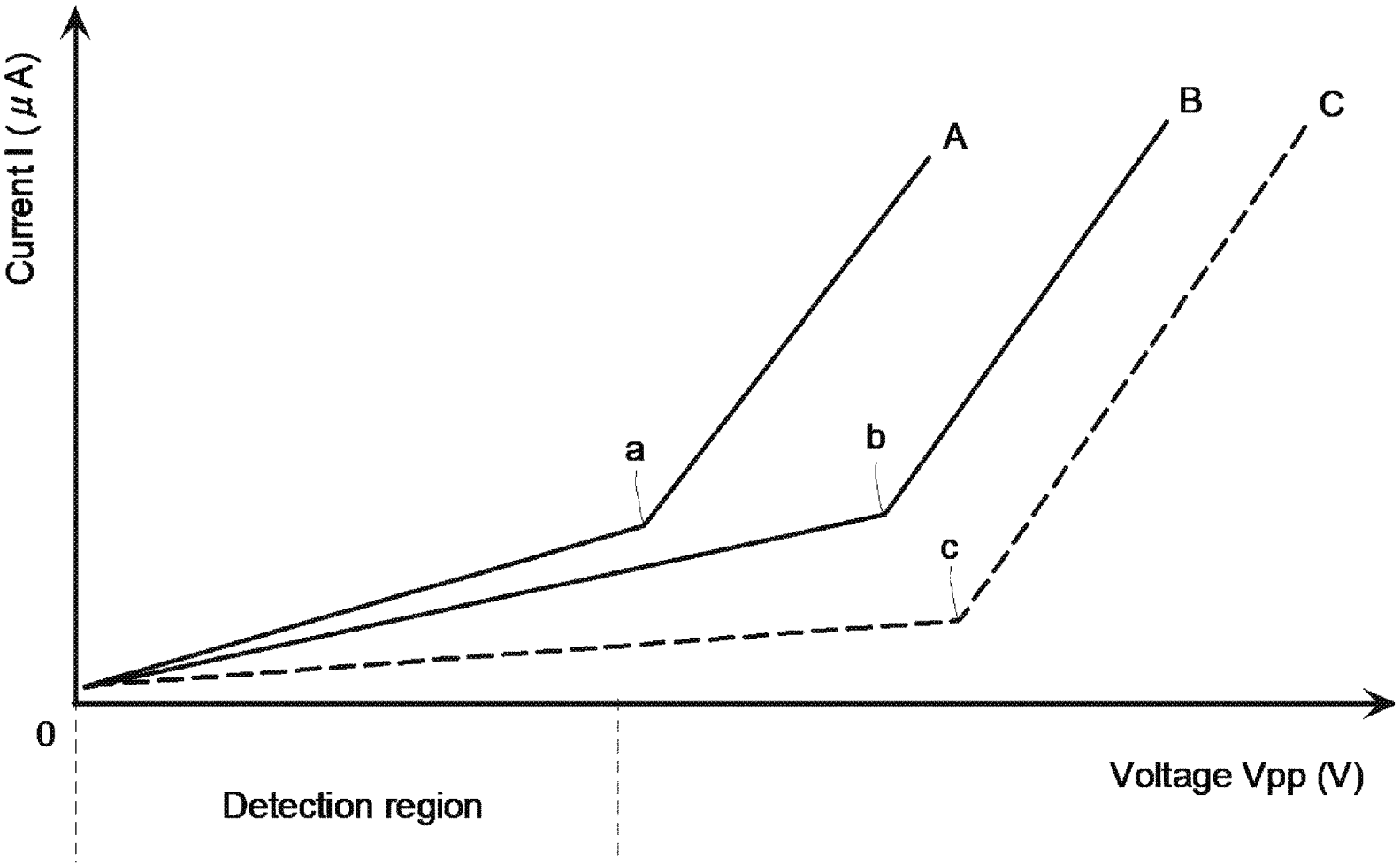
FIG. 3 is a graph showing voltage-current characteristics according to an example.

A gap size acquisition unit (or gap size acquisition device) 81 of a control unit (or controller) 80, in combination with the voltage control unit (or voltage control device) 82, enables a voltage application unit (or voltage application device) 71 to generate an AC voltage (first detection voltage), and the AC voltage is applied to the conductive rotation axle 2*b* of the application roller 2. In this case, the frequency of the AC voltage may be constant. This AC voltage to be used is, as indicated as a detection region in FIG. 3, a voltage lower than a voltage for starting electric discharge (discharge starting voltage) at a location where the surface of the photosensitive drum 40 and the conductive member (e.g., application roller 2) are in contact with each other. A current flowing through the photosensitive drum 40 is measured by the current detector 76 and is provided to the gap size acquisition unit (or gap size acquisition device) 81. The thus-acquired voltage-current characteristic (hereinafter, referred to as contact VI characteristic) is indicated by the graph line A in FIG. 3 as one example. In FIG. 3, points a, b and c indicate discharge starting voltages. For example, point a may be at about 1400 $V_{pp}$, point b may be at about 1700 $V_{pp}$, and point c may be at about 1900 $V_{pp}$. For ease of understanding, FIG. 3 shows contact VI characteristics in the case of exceeding the discharge starting voltages. Graph lines B and C will be described further below. The graph line for contact VI characteristic A in the detection region is expressed by a straight line. The voltage-current ratio represents an impedance Z1, which may denote (e.g., be indicative of) a surface film thickness of the photosensitive drum 40 (film thickness of the charge transport layer 40*a*).

Next, the gap size acquisition unit (or device) 81 of the control unit (or controller) 80, in combination with the voltage control unit (or device) 82, enables the voltage application unit (device) 70 to generate an AC voltage (second detection voltage), and the AC voltage is applied to the conductive support 41*c* of the charging roller 41. In this case, the frequency of the AC voltage is constant, and it may be the same as the first detection voltage. This AC voltage to be used herein is, as indicated as a detection region in FIG. 3, a voltage lower than a voltage for starting electric discharge (discharge starting voltage) at a location where the charging roller 41 faces the photosensitive drum 40 with a gap G therebetween. A current flowing through the photosensitive drum 40 is measured by a current detector 75 and provided to the gap size acquisition unit (or device) 81. In FIG. 2, the voltage application units (devices) 70 and 71 are indicated as separate units. In some examples, the voltage application units (devices) 70 and 71 may be configured as a single unit.

The voltage-current characteristic (also referred to herein as non-contact VI characteristic) acquired as described above is indicated as one example by graph line B or C in FIG. 3. Graph line B indicates a voltage-current characteristic when the size of gap G is less than that of graph line C. Graph line B or C of non-contact VI characteristic in the detection region is expressed by a straight line. The voltage-current ratio represents an impedance Z, which may denote a sum of a surface film thickness of the photosensitive drum 40 (film thickness of the charge transport layer 40*a*) and the size of gap G. For example, the impedance Z obtained from the non-contact VI characteristic is composed of an impedance Z1 obtained from the contact VI characteristic and an impedance Z2 representing the size of gap G. The impedance Z may be expressed by:

$$Z=Z1+Z2 \quad (1a).$$

The above expression (1a) may be expressed as follows:

$$Z2=Z-Z1 \quad (1b).$$

The gap size acquisition unit (or device) 81 may determine the impedance Z1 from the above-described contact VI characteristic, and may determine the impedance Z from the non-contact VI characteristic. Then, the gap size acquisition unit (device) 81 may determine the size of gap G by using the relation of the expression (2) and a correlation between the impedance Z2 (which will be described further below) and the size of gap G. For example, the gap size acquisition unit (device) 81 may determine the size of gap G based on the contact VI characteristic and the non-contact VI characteristic.

It is considered that a parallel-plate capacitor is formed by the gap G between the photosensitive drum 40 and the charging roller 41. The capacitance C of the parallel-plate capacitor may be expressed by:

$$C=\varepsilon S/d \quad (2).$$

In the above-expression (2), ε represents a dielectric constant, S represents an area of a parallel-plate, and d represents a distance between plates (corresponding to the size of gap G). In addition, the impedance $Z_c$ of the capacitor may be expressed by:

$$Z_c=1/j\omega C \quad (3).$$

From the above-expressions (2) and (3), d may be expressed by the following expression:

$$d=\varepsilon S\cdot j\omega\cdot Z_c \quad (4)$$

In the above-expression (4), ε and S are constants; and when the frequency of the detection voltage is constant, jω is also a constant. Thus, the gap size d of the gap G may be expressed by:

$$d=k\times Z2 \quad (5).$$

Figure 4:
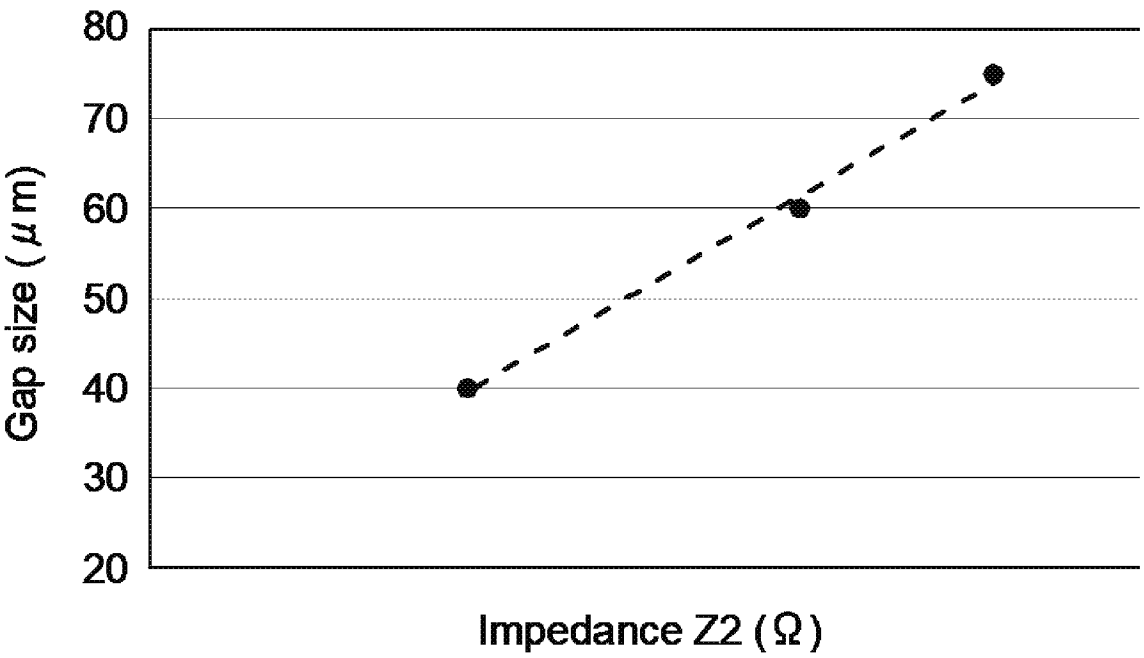
FIG. 4 is a graph of an example relationship of an impedance Z2 relative to a gap size.

In the above-expression (5), k is a constant coefficient. Coefficient k may be determined by a preliminary experimentation. For example, an example relationship between the size of gap G and the impedance Z2 is illustrated in FIG. 4. Thus, a value for the coefficient k may be determined from the relationship illustrated in FIG. 4. The gap size acquisition unit (or device) 81 may acquire the size of gap G based on the coefficient k and the above expression (5). The size of gap G or the gap information on the gap size determined by the gap size acquisition unit (or device) 81 may be passed to a gap adjustment unit (or gap adjustment device) 84.

Figure 5:
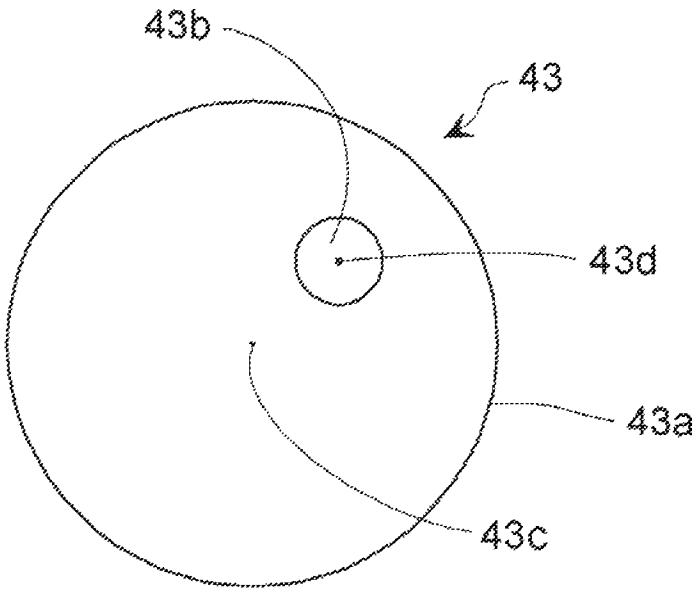
FIG. 5 is a schematic cross-sectional view of an eccentric cam of an example gap adjustment device.

Adjusting the size of gap G will be further described by referring to FIGS. 5 and 6. In some examples, the size of gap G between the photosensitive drum 40 and the charging roller 41 may be maintained at an optimal (or target) value (e.g., 10 μm) or within a predetermine range (e.g., 10 μm to 30 μm) by using a plate-like eccentric cam 43 to adjust a distance between the rotation axle 40*e* of the photosensitive drum 40 and the rotation axle 41*c* of the charging roller 41. FIG. 5 shows a schematic cross-sectional view of the eccentric cam 43 according to an example. In FIG. 5, the eccentric cam 43 has an outer circumferential surface 43*a*, and a rotation axle 43*b* provided at a position that is radially offset away from a center point 43*c* of the eccentric cam. In FIGS. 5 and 6, the shape of the eccentric cam 43 is indicated to have a circular shape (e.g., as a complete circle). In other examples, the eccentric cam 43 may have other shapes such as an elliptical shape instead of a circular shape.

Figure 6B:
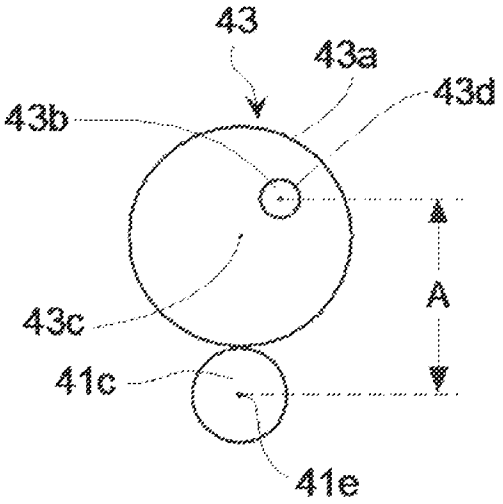
FIG. 6B is a schematic cross-sectional view of the components illustrated in FIG. 6A, taken along a plane that intersects the eccentric cam.
Figure 6A:
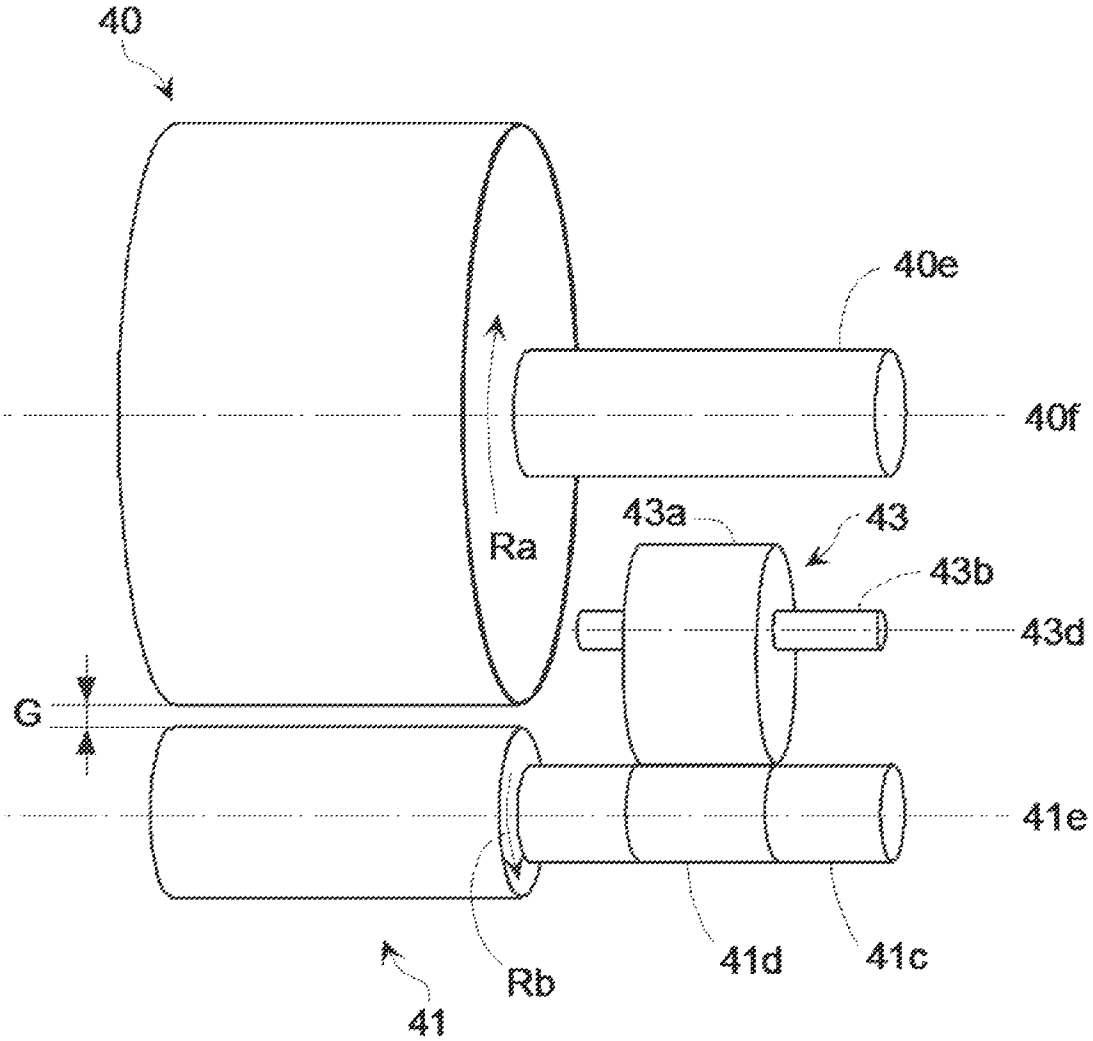
FIG. 6A is a schematic perspective view illustrating an example components of an imaging system, including a photosensitive drum having an eccentric cam

FIGS. 6A and 6B illustrate the photosensitive drum 40 and surrounding components including the eccentric cam 43. FIG. 6A is a perspective view and FIG. 6B is a schematic cross-sectional view illustrating the eccentric cam 43 and the rotation axle 41*c* of the charging roller 41. For better ease of understanding, FIG. 6A shows one end portion of the photosensitive drum 40 and of other components. The two end portions of the rotation axle 40*e* of the photosensitive drum 40 may be supported by respective support members, and may be rotated in a direction of arrow Ra at a constant speed about the rotation axle 40*e* by a drive motor.

The charging roller 41 may be rotated in a direction of arrow $R_b$ about the rotation axle 41*c* by a drive motor as it follows the rotation of the photosensitive drum 40. The eccentric cam 43 is disposed so that its outer circumferential surface 43*a* slides while abutting with a region 41*d* of the rotation axle 41*c* of the charging roller 41. In this case, the region 41*d* may include, for example, a bearing member or a layer of a resin with a low frictional property, to reduce friction with the charging roller 41 (e.g., improve sliding). The eccentric cam 43 may be supported by support members so that it may be rotated about the rotation axle 43*b* by a drive device operable based on a control signal from the gap adjustment unit (or device) 84 of the control unit (controller) 80. The eccentric cam 43 may remain fixed (e.g., not rotatable) except for adjusting the size of gap G.

The rotation axle 41*c* of the charging roller 41 abuts with the outer circumferential surface 43*a* of the eccentric cam 43 at the region 41*d*, and thereby, the charging roller 41 is disposed adjacent to the photosensitive drum 40 in a non-contact manner so that a predetermined size of the gap G is formed between the photosensitive drum 40 and the charging roller 41. In order to change the size of gap G by a rotation of the eccentric cam 43, both end portions of the rotation axle 41*c* of the charging roller 41 are movably supported by support members in a direction perpendicular to the rotation axle 41*c*, and urged by an biasing member so as to abut the region 41*d* with the outer circumference surface 43*a* of the eccentric cam 43. As described above, the rotation axle 43*b* of the eccentric cam 43 is provided at a position that is radially offset away from the center point 43*c* of the eccentric cam 43. Accordingly, with reference to FIG. 6B, a rotation of the eccentric cam 43 about the rotation axle 43*b* may change a distance A between the central axis 43*d* of the rotation axle 43*b* and the central axis 41*e* of the rotation axle 41*c* of the charging roller 41. Accordingly, a rotation of the eccentric cam 43 may adjust (change) a distance between the rotation axle 40*e* of the photosensitive drum 40 and the rotation axle 41*c* of the charging roller 41, in order to maintain the size of gap G at an optimal or target value or within a predetermined range.

As described above, the gap adjustment unit (or device) 84 of the control unit (or device) 80 receives the size of gap G from the gap size acquisition unit (or device) 81. Based on the received gap size, the gap adjustment unit (or device) 84 may determine whether to adjust the size of gap G. When it is determined to adjust the gap size, the gap adjustment unit (device) 84 sends a control signal to a drive device for rotating the rotation axle 43*b* of the eccentric cam 43. Based on the control signal, the drive device may rotate the eccentric cam 43 by a predetermined amount so that the size of gap G is at an optimal (or target) value or within a predetermined range.

In addition, when the gap adjustment unit (device) 84 determines that the gap size has to be adjusted, it may also determine whether the adjustment range of the size of gap G exceeds such a range that may be adjusted by the eccentric cam 43. When it is determined that it exceeds such an adjustable range, the gap adjustment unit (device) 84 may energize an alarm unit (or device) 83. Accordingly, the alarm unit (or device) 83 may stop an image forming operation of the image forming apparatus 1 and warn a user of an occurrence of a malfunction in the image forming apparatus 1.

As described above, according to some examples the gap adjustment device 84 may actively (mechanically) adjust the size of gap G that tends to increase to maintain the size of gap G at an optimal (or target) value or within a predetermined range, and to thereby stabilize the discharge characteristic in the charging process to enhance the image quality.

Detection of Service Life of Charging Roller

As described above, referring back to FIG. 1, the photosensitive drum 40, the charging roller 41 and the cleaning unit 44 may be formed in a single unit, which may be referred to as an OPC unit (or device). The service life of this OPC unit is often predicted by monitoring an abraded film thickness of the charge transfer layer 40*a* of the photosensitive drum 40. However, in the method wherein a lubricant agent is applied onto a surface of the photosensitive drum 40 by use of the application roller 2 as shown in FIG. 2, abrasion of the charge transport layer 40*a* of the photosensitive drum 40 is reduced, and therefore, the charging roller 41 possibly reaches its end of service life earlier than the photosensitive drum 40. Hence, it is increasingly useful to monitor a service life of the charging roller.

Figure 7:
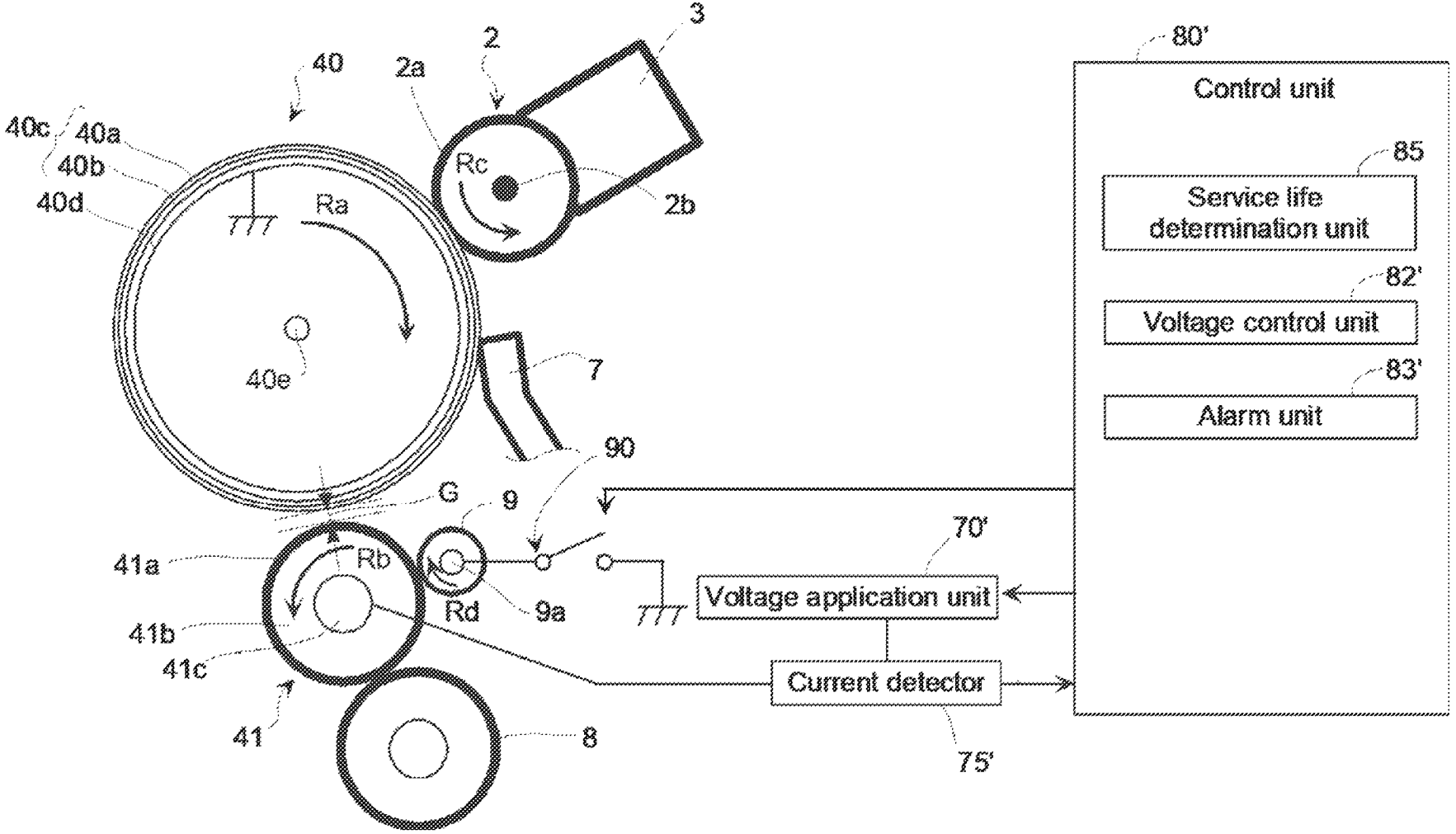
FIG. 7 is a schematic diagram illustrating example components of an image forming apparatus, including a photosensitive drum.

The film thickness of the surface layer 41*a* of the charging roller 41 is decreased by electric discharge and other effects in the charging process, and reaches a nominal service life. Hereafter, the determination of service life of the charging roller 41 will be described by referring to FIG. 7. FIG. 7 is a schematic diagram illustrating a configuration of components in the vicinity of the photosensitive drum 40 according to another example. For better ease of understanding, part of the developing device 20 and other components are omitted in FIG. 7.

The determination of the service life of the charging roller 41 is made by applying a voltage to the charging roller 41 and measuring a current through the charging roller 41. Accordingly, in the example of FIG. 7, for detecting the current through the charging roller 41, a current detection roller 9 as a contact conductive member may be disposed in such a state as to be in contact with the charging roller 41. The current detection roller 9 may be a metal roller of, for example, stainless (e.g., stainless steel) and others. In addition, the current detection roller 9 may have an electric resistance of 30 ohms or less in some examples. The electric resistance value of the current detection roller may be 1/100 or less of the resistance value of the charging roller 41 from the viewpoint of preventing the reduction in the determination accuracy of the service life of the charging roller 41.

Figure 8:
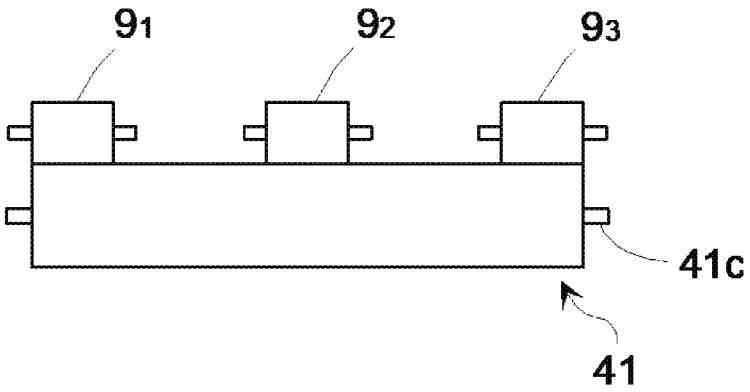
FIG. 8 is a schematic diagram illustrating an example current detection roller.

The current detection roller 9 is rotatably supported at both end portions of a conductive rotation axle 9*a*, for example by bearing members, and it rotates in a direction of arrow Rd to follow the rotation of the charging roller 41. In some examples, the current detection roller 9 may abut (e.g., contact) over the entire length (or a substantial portion of the length) of the charging roller 41, along a longitudinal direction of the charging roller 41. In other examples, the current detection roller 9 may include the current detection rollers $\mathbf{9}_1$ to $\mathbf{9}_3$ which are in abutment (e.g., in contact) with the charging roller 41 along respective regions spaced apart in the longitudinal direction of the charging roller 41, as illustrated in FIG. 8. In the example of FIG. 8, three current detection rollers $\mathbf{9}_1$ to $\mathbf{9}_3$ are indicated. The number of current detection rollers is not limited to three and in some examples, the contact conductive member may include two, or four or more current detection rollers. In addition, the current detection roller 9 may be configured to abut with (e.g., contact) the charging roller 41 selectively when detecting a service life of the charging roller 41.

Figure 9A:
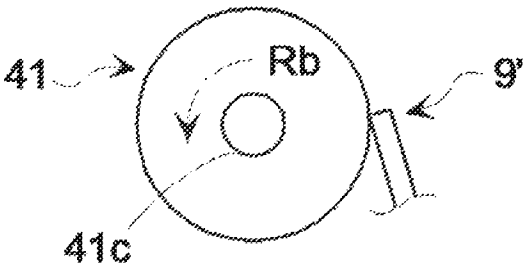
FIG. 9A is a schematic front plan view of example components including a charging roller and a current detection blade.
Figure 9B:
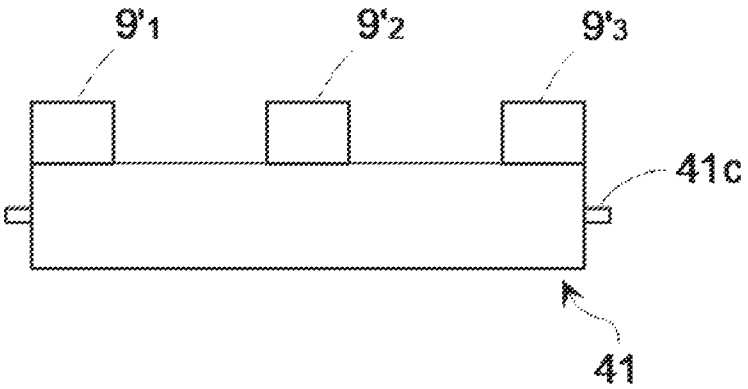
FIG. 9B is a schematic side plan view of the example components illustrated in FIG. 9A.

FIGS. 7 and 8 show examples wherein the contact conductive members abutting with the charging roller 41 have a shape of a roller (e.g., current detection roller 9). In some examples, the contact conductive member may include a current detection blade 9', which is formed in the shape of a blade as shown in FIG. 9A. The current detection roller 9' may be configured to be abutted (e.g., in contact) with the surface of the charging roller 41. In some examples, current detection blade 9' may be abutted over the entire length (or substantial portion of the length) of the charging roller 41, along the longitudinal direction of the charging roller 41. In some examples, the current detection blade 9' may include current detection blades $\mathbf{9'}_1$ to $\mathbf{9'}_3$ which are abutted (e.g., in contact) with the charging roller 41 in respective regions spaced apart along the longitudinal direction of the charging roller 41, as illustrated in FIG. 9B. In the example of FIG. 9B, three current detection blades $\mathbf{9'}_1$ to $\mathbf{9'}_3$ are illustrated. The number of current detection blades is not limited to three and in some example, the contact conductive member may include two or, four or more current detection blades. In some example, the current detection blade 9' may be configured to abut with (e.g., contact) the charging roller 41 selectively when detecting a service life of the charging roller 41.

Referring back to FIG. 7, a voltage application unit (or voltage application device) 70' may be similar to the voltage application unit (device) 70 described with reference to FIG. 2. The voltage application unit (device) 70' may be controlled by a voltage control unit (device) 82', to output a predetermined charging voltage when an image is formed and to output a detection voltage, different from the charging voltage, when a service life of the charging roller 41 is determined. The voltage application unit (device) 70' may include a DC power and an AC power, to apply a voltage having an AC voltage superimposed on a DC voltage to the charging roller 41 when the photosensitive drum 40 is charged.

The determination of a service life of the charging roller 41 may be made at a time when the image forming apparatus 1 does not form an image (e.g., when the image forming apparatus 1 does not perform a printing operation). For example, the determination of a service life of the charging roller 41 may be made during a pre-rotation period that is a warming-up period of the image forming apparatus 1 or a post-rotation period that is a period after the end of image formation (e.g., printing operation).

An example process for the determination of a service life of the charging roller 41 in the image forming apparatus 1 will be described with reference to FIG. 7. A service life determination unit (or service life determination device) 85 of a control unit (controller) 80' turns on a switch 90 to connect the current detection roller 9 to a ground. A default state of the switch 90 may be an off state; and in that case, the current detection roller 9 is in a floating state. Thereafter, the service life determination unit 85, in combination with the voltage control unit (device) 82', instructs the voltage application unit (device) 70' to generate a detection voltage, and the voltage application unit (device) 70' may apply the detection voltage to the charging roller 41. The detection voltage may be an AC voltage or a DC voltage. A current detector 75' detects a current through the charging roller 41, and sends a value of the current to the service life determination unit (device) 85.

Figure 10:
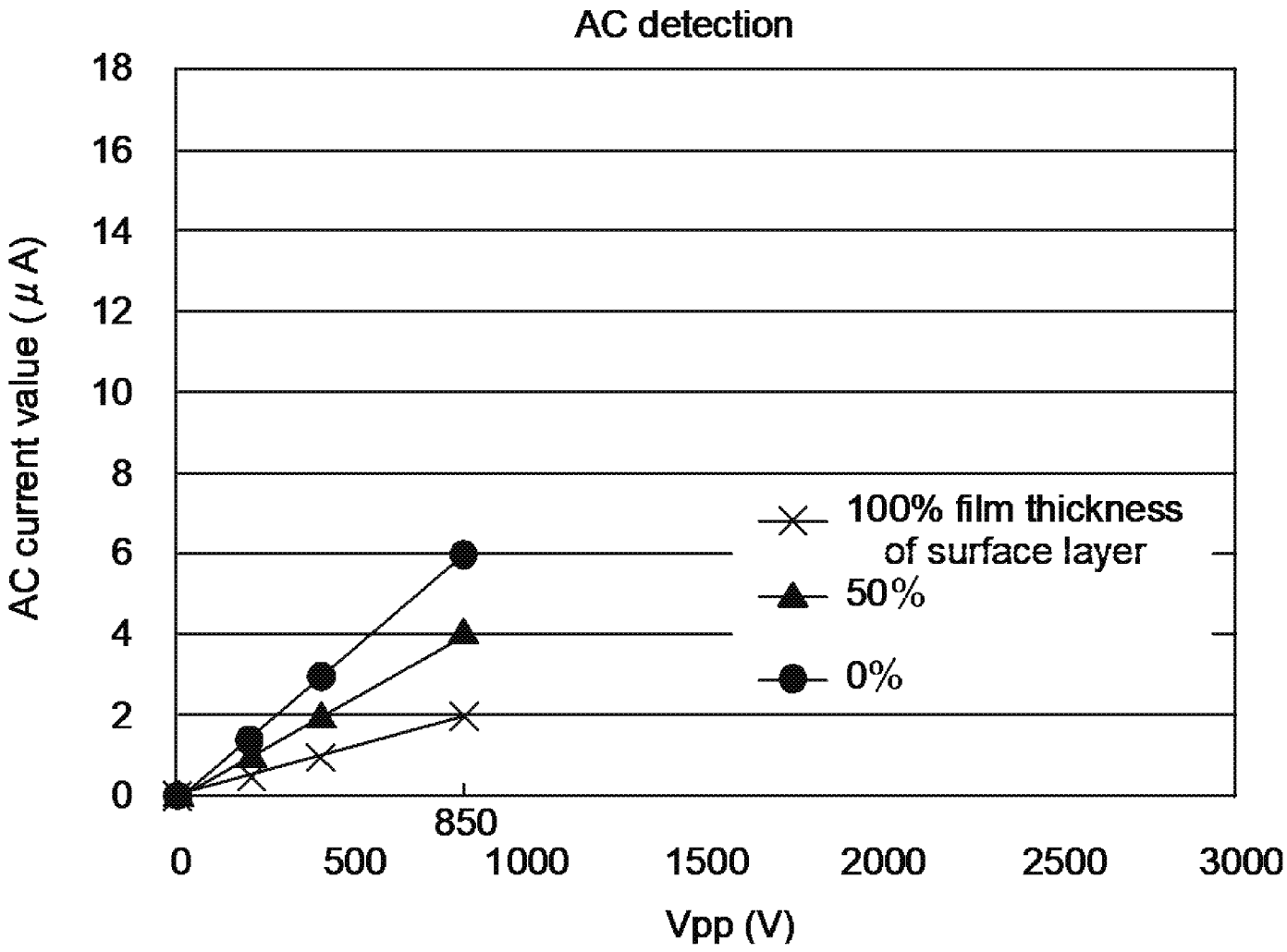
FIG. 10 is a graph illustrating voltage-current characteristics of an example charging roller having a surface layer, for film thicknesses of 100%, 50% or 0% of the surface layer of the charging roller.

FIG. 10 shows a graph of the voltage-current characteristics associated with the example charging roller 41 having a film thickness of 100%, 50% and 0% of the surface layer 41*a* of the charging roller 41, which are obtained by a preliminary experimentation using AC voltages as detection voltages. The 100% film thickness represents a condition of the charging roller 41 being new; the 50% film thickness represents a condition of the charging roller 41 having reached about a half of the service life; and the 0% film thickness represents a condition of the charging roller 41 having reached an end of the service life. Based on the graph, the current that flows through the charging roller, increases as the film thickness of the surface layer 41*a* of the charging roller 41 decreases. In the graph, the horizontal axis indicates the inter-peak voltages $V_{pp}$ to be applied to the charging roller 41 and the vertical axis shows values of AC current flowing through the charging roller 41. When AC voltages are used, the detection voltage to be used is twice or less of a voltage for stating electric discharge (discharge starting voltage) at a location where the charging roller 41 and the current detection roller 9 abut with each other, and for example, a voltage of 850 $V_{pp}$ or less may be used. For convenience, FIG. 10 shows voltage-current characteristics at voltages of 850 $V_{pp}$ or less.

Figure 11:
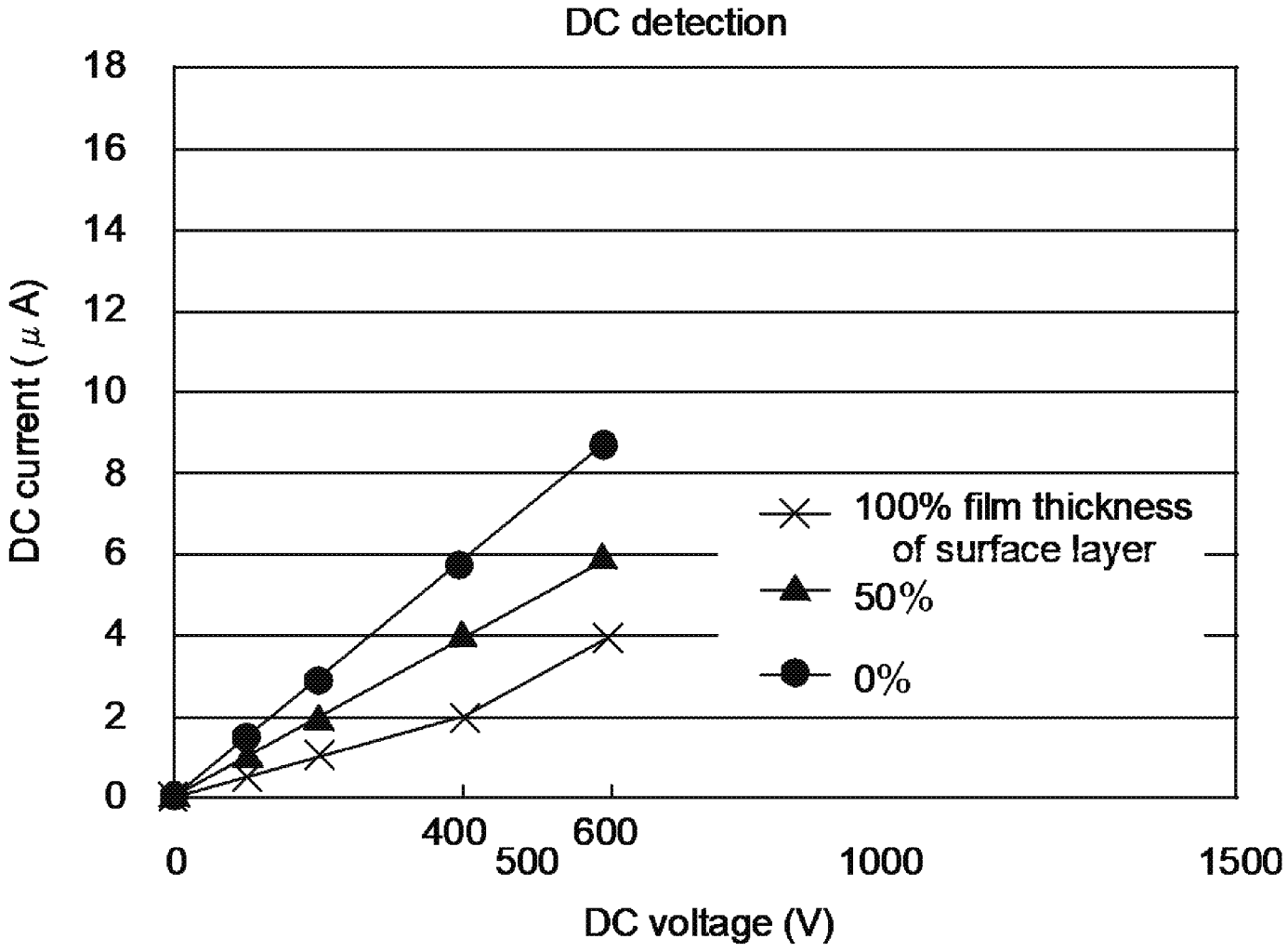
FIG. 11 is a graph illustrating voltage-current characteristics of an example charging rollers having a surface layer, for film thicknesses of 100%, 50% or 0% of the surface layer of the charging roller.

FIG. 11 shows voltage-current characteristics for 100%, 50% and 0% film thickness of the surface layer 41*a* of the charging roller 41, which are obtained by a preliminary experimentation using DC voltages as detection voltages. The 100% film thickness represents a condition of the charging roller 41 being new; the 50% film thickness represents a condition of the charging roller 41 having reached about a half of the service life; and the 0% film thickness represents a condition of the charging roller 41 having reached an end of the service life. Based on the graph, the current flowing through the charging roller increases, as the film thickness of the surface layer 41*a* of the charging roller 41 decreases. In the graph, the horizontal axis indicates DC voltages to be applied to the charging roller 41 and the vertical axis shows values of DC current flowing through the charging roller 41. When DC voltages are used, the detection voltage to be used is lower than a voltage for starting electric discharge (discharge starting voltage) at a location where the charging roller 41 and the current detection roller 9 abut with each other, and for example, a voltage of 400 V or less may be used. The graph line for the 100% film thickness starts electric discharge around a voltage higher than 400 V, and thus, the tilt of the graph line for the 100% film thickness starts to increase around a voltage higher than 400 V. Hence, a voltage of 400 V or less is used as the detection voltage.

The service life determination unit (device) 85 may store or hold information regarding voltage-current characteristics as indicated in FIGS. 10 and 11. The service life determination unit (device) 85 may determine whether the film thickness of the surface layer 41*a* of the charging roller 41 has reached an end of service life based on the value of applied detection voltage and the current value from the current detector 75', and the correlation between the film thickness of the surface layer 41*a* of the charging roller 41 and the voltage-current as shown in FIG. 10 or 11. When AC voltages, for example, are used for detection, the voltage application unit (device) 70' applies, for example, an AC voltage of 850 $V_{pp}$ to the charging roller 41. Then, when the current detector 75' detects that a current through the charging roller 41 is 6 μA, the service life determination unit (device) 85 may determine that the charging roller 41 has reached an end of service life. In addition, when it is detected that a current through the charging roller 41 is 4 μA, the service life determination unit (device) 85 may determine that the charging roller 41 has reached about a half of service life.

When DC voltages are used for detection, the voltage application unit (device) 70' applies, for example, a DC voltage of 400 V to the charging roller 41. When the current detector 75' detects that a current through the charging roller 41 is 6 μA, the service life determination unit (device) 85 may determine that the charging roller 41 is approaching or has reached the end of its service life. In addition, when it is detected that a current through the charging roller 41 is 4 μA, the service life determination unit (device) 85 may determine that the charging roller 41 has reached about a half of the service life.

When the service life determination unit (device) 85 determines that the charging roller 41 has reached the end of its service life, the service life determination unit (device) 85 may energize (or trigger) an alarm unit (or alarm device) 83'. Accordingly, the alarm unit (device) 83' may stop an image forming operation of the image forming apparatus 1, and output a warning indicator to a user, of an occurrence of a malfunction in the image forming apparatus 1, in order to urge the user to exchange OPC units or the like.

As described above, the service life of the charging roller may be better monitored and this enables an appropriate operation of the image forming apparatus.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An image forming apparatus comprising:

an image carrier having a first rotation axle;

a charging roller having a second rotation axle extending parallel with the first rotation axle, the charging roller being disposed adjacent to the image carrier in a non-contact manner to charge the image carrier, wherein a gap is formed between the charging roller and the image carrier;

a conductive member to contact a surface of the image carrier;

a gap size acquisition device to acquire a first voltage-current characteristic associated with a surface film thickness of the image carrier, to acquire a second voltage-current characteristic associated with a sum of the surface film thickness of the image carrier and a size of the gap, and to acquire the size of the gap based on the first voltage-current characteristic and the second voltage-current characteristic; and a gap adjustment device to adjust a distance between the first rotation axle and the second rotation axle based on information acquired from the gap size acquisition device, to maintain the size of the gap within a predetermined range.

2. The image forming apparatus according to claim 1, the gap size acquisition device to:

apply a first voltage to the conductive member to detect a first current through the image carrier, and to thereby acquire the first voltage-current characteristic associated with the surface film thickness of the image carrier;

apply a second voltage to the charging roller to detect a second current through the image carrier, and to thereby acquire the second voltage-current characteristic associated with the sum of the surface film thickness of the image carrier and the size of the gap; and acquire the size of the gap based on the first voltage-current characteristic and the second voltage-current characteristic.

3. The image forming apparatus according to claim 2, wherein the first voltage and the second voltage are each lower than a discharge starting voltage.

4. The image forming apparatus according to claim 1, wherein the conductive member includes a lubricant coater device having a rotatable conductive elastic body to apply a lubricant agent to the surface of the image carrier.

5. The image forming apparatus according to claim 1, wherein the conductive member includes a conductive cleaning blade to clean the surface of the image carrier.

6. The image forming apparatus according to claim 1, wherein the gap adjustment device includes an eccentric cam abutting with the second rotation axle.

7. The image forming apparatus according to claim 6, wherein the eccentric cam includes a third rotation axle mounted at a position that is radially offset from a center of the eccentric cam.

8. The image forming apparatus according to claim 7, comprising a drive device to rotate the third rotation axle of the eccentric cam so as to adjust the size of the gap.

9. The image forming apparatus according to claim 1, comprising an alarm device to generate an alarm when the size of the gap exceeds a predetermined adjustment range.

10. A method of adjusting a size of a gap in an image forming apparatus including a charging roller disposed adjacent to a rotatable image carrier in a non-contact manner across the gap, comprising:

applying a first voltage to a conductive member that is in contact with a surface of the image carrier to detect a first current through the image carrier, thereby acquiring a first voltage-current characteristic associated with a surface film thickness of the image carrier;

applying a second voltage to the charging roller to detect a second current through the image carrier, thereby acquiring a second voltage-current characteristic associated with a sum of the surface film thickness of the image carrier and a size of the gap;

acquiring the size of the gap based on the first voltage-current characteristic and the second voltage-current characteristic; and adjusting a distance between a rotation axle of the charging roller and a rotation axle of the image carrier based on the size of the gap acquired.

11. The method according to claim 10, wherein the adjusting the distance is performed by rotating an eccentric cam in abutment with the rotation axle of the charging roller.

12. The method according to claim 10, wherein the first voltage and the second voltage are each lower than a discharge starting voltage.

13. The method according to claim 12, wherein the conductive member is a lubricant coater device having a rotatable conductive elastic body to apply a lubricant agent on the surface of the image carrier.

14. The method according to claim 12, wherein the conductive member is a conductive cleaning blade to clean the surface of the image carrier.

15. The method according to claim 14, comprising generating an alarm when the size of the gap acquired exceeds a predetermined adjustment range.

16. An image forming apparatus comprising:

an image carrier having a first rotation axle;

a charging roller having a second rotation axle extending parallel with the first rotation axle, the charging roller being disposed adjacent to the image carrier in a non-contact manner to charge the image carrier, wherein a gap is formed between the charging roller and the image carrier;

a conductive member to contact a surface of the image carrier; and a gap size acquisition device to:

apply a first voltage to the conductive member to detect a first current through the image carrier, and to thereby acquire a first voltage-current characteristic associated with a surface film thickness of the image carrier, apply a second voltage to the charging roller to detect a second current through the image carrier, and to thereby acquire a second voltage-current characteristic associated with a sum of the surface film thickness of the image carrier and the size of the gap, and acquire the size of the gap based on the first voltage-current characteristic and the second voltage-current characteristic; and a gap adjustment device to adjust a distance between the first rotation axle and the second rotation axle based on information acquired from the gap size acquisition device.

17. The image forming apparatus according to claim 16, wherein the first voltage and the second voltage are each lower than a discharge starting voltage.

18. The image forming apparatus according to claim 16, wherein the conductive member includes a lubricant coater device having a rotatable conductive elastic body to apply a lubricant agent to the surface of the image carrier.

19. The image forming apparatus according to claim 16, wherein the conductive member includes a conductive cleaning blade to clean the surface of the image carrier.

20. The image forming apparatus according to claim 16, wherein the gap adjustment device includes an eccentric cam abutting with the second rotation axle.

* * * * *